US005582199A

United States Patent [19]

Schmidt et al.

[11] Patent Number: 5,582,199

[45] Date of Patent: Dec. 10, 1996

[54] DEVICE FOR SECURING AN OUTLET HOSE AND AN INLET HOSE OR INLET VALVE IN A DOMESTIC APPLIANCE SUCH AS A WASHING MACHINE, DISHWASHER AND THE LIKE

[75] Inventors: Friedrich H. Schmidt; Helga E. Schmidt, both of Neunkirchen, Germany

[73] Assignee: Whirlpool Europe B.V., Veldhoven, Netherlands

[21] Appl. No.: 548,123

[22] Filed: Oct. 25, 1995

[30] Foreign Application Priority Data

Oct. 25, 1994 [DE] Germany ..... 44 38 057.7

[51] Int. Cl.[6] ..... B65H 75/34; F16L 3/22

[52] U.S. Cl. ..... 137/360; 137/343; 137/355.17; 248/68.1; 248/74.2; 312/229

[58] Field of Search ..... 68/207; 312/229; 137/360, 343, 355.17; 248/68.1, 74.2

[56] References Cited

U.S. PATENT DOCUMENTS

| | | | |
|---|---|---|---|
| 2,534,690 | 12/1950 | Young, Jr. et al. | 248/68.1 |
| 3,092,360 | 6/1963 | Cook et al. | 248/56 |
| 3,381,700 | 5/1968 | Frymark | 68/207 |
| 4,244,542 | 1/1981 | Mathews | 248/68.1 |
| 4,306,697 | 12/1981 | Mathews | 248/74.2 |
| 4,860,791 | 8/1989 | Putnam | 137/565 |
| 4,870,988 | 10/1989 | Hood, Jr. et al. | 137/355.17 |
| 5,272,934 | 12/1993 | Chegash et al. | 75/502.4 |

FOREIGN PATENT DOCUMENTS

| | | | |
|---|---|---|---|
| 3524278 | 1/1987 | European Pat. Off. | F16L 5/14 |
| 0446429 | 9/1991 | European Pat. Off. | F16L 5/10 |
| 2492017 | 4/1982 | France | D06F 39/12 |
| 8031452 | 3/1980 | Germany | D06F 39/08 |
| 8412260 | 9/1985 | Germany | D06F 39/12 |
| 8529264 | 3/1986 | Germany | D06F 39/12 |

*Primary Examiner*—A. Michael Chambers

*Attorney, Agent, or Firm*—Mark A. Davis; Thomas A. Schwyn; Thomas J. Roth

[57] ABSTRACT

The invention relates to a device for securing an outlet hose and an inlet hose or an inlet valve to a rear wall baffle of a domestic appliance such as a washing machine, dishwasher and the like. The outlay on parts and assembly is considerably reduced in that there is provided in the rear wall baffle an opening into which a retaining portion may be resiliently engaged, and in that the retaining portion has two outwardly open resilient engagement openings, into which the outlet hose and the inlet hose or the inlet valve may be resiliently engaged and axially immovably secured before resilient engagement of the retaining portion in the opening in the rear wall baffle.

12 Claims, 1 Drawing Sheet

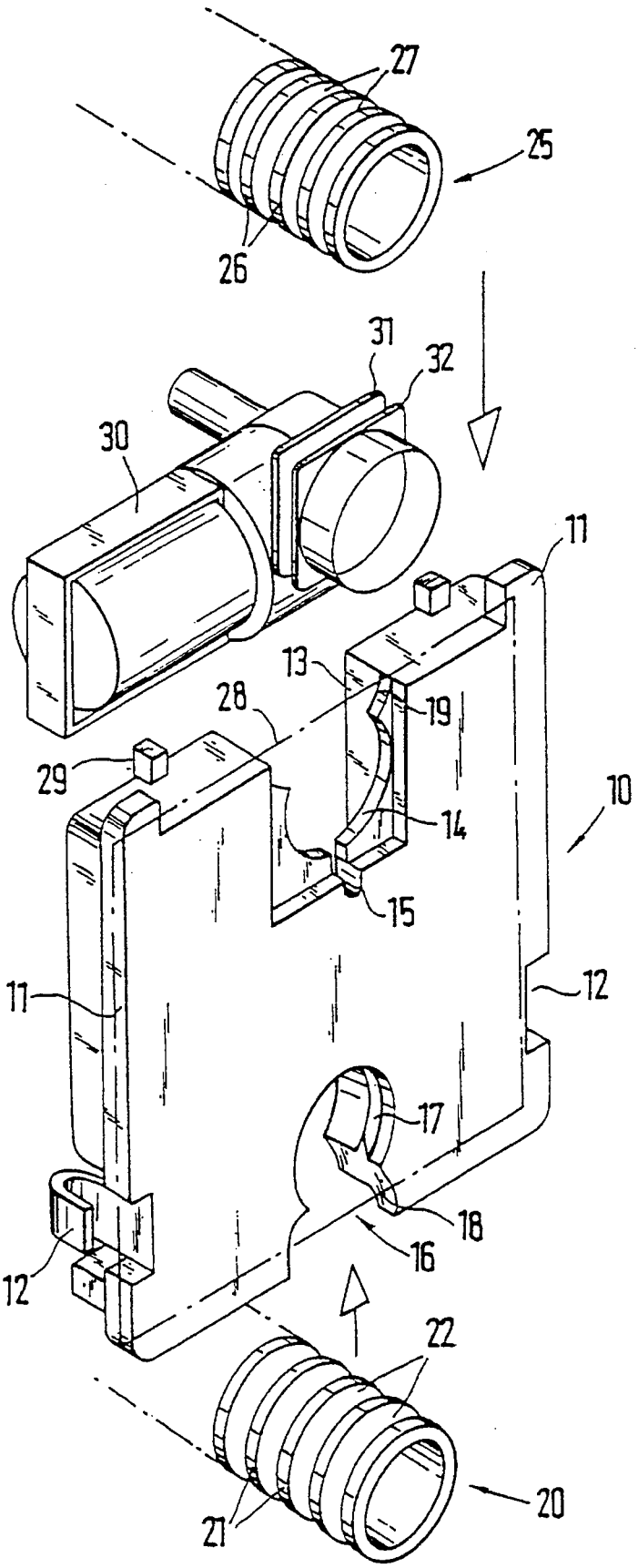
27
25
26
31
32
30
11
13
19
28
29
14
10
15
11
12
17
18
16
12
22
20
21

DEVICE FOR SECURING AN OUTLET HOSE AND AN INLET HOSE OR INLET VALVE IN A DOMESTIC APPLIANCE SUCH AS A WASHING MACHINE, DISHWASHER AND THE LIKE

BACKGROUND OF THE INVENTION

1. Field of the Invention

The invention relates to a device for securing an outlet hose and an inlet hose or inlet valve to a rear wall baffle of a domestic appliance such as a washing machine, dishwasher and the like.

2. Description of the Related Art

In known devices, the outlet hose and the inlet hose or inlet valve are attached separately on the rear wall baffle. For this purpose a plurality of securing means are required, which in addition requires a considerable outlay on assembly.

SUMMARY OF THE INVENTION

It is the purpose of the invention to provide a device of the type already mentioned, in which securing and axial fixing are achieved with simple means and simple assembly.

This purpose is achieved according to the invention in that an aperture is provided in the rear wall baffle, into which a retaining portion may be resiliently engaged, in that the retaining portion has two engagement openings which are open towards the outside, into which the outlet hose or the inlet hose or the inlet valve may be resiliently engaged and axially immovably fixed before the retaining portion is resiliently engaged in the aperture in the rear wall baffle.

In this development only the retaining portion is necessary, in which the outlet hose and the inlet hose or the inlet valve are resiliently engaged. Thus axial fixing is undertaken simultaneously with the resilient engagement. If the outlet hose and the inlet hose or inlet valve are secured to the retaining portion in this way, then the retaining portion need only be resiliently engaged in the aperture in the rear wall baffle. Assembly is extremely simple, requires no further fixing means, and may be undertaken very rapidly.

According to one development for securing the retaining portion on the rear wall baffle, the securing portion is plate-shaped and square or rectangular in form; stop means and engagement springs are integrally formed on the retaining portion, the stop means defining the movement of resilient engagement by stopping at one side of the rear wall baffle, and the engagement springs engaging resiliently behind the other side of the rear wall baffle.

In the other development, the resilient engagement apertures are located on mutually-opposed sides of the retaining portion, and are round in shape, extending over slightly more than 180°, as the hoses have a circular cross-section and are resilient.

The resilient engagement of the outlet hose and of the inlet hose or inlet valve is simplified in that the resilient engagement apertures are provided with widened insert openings.

A constructive development of the device is characterised in that the resilient engagement apertures extend with a retaining groove or a retaining web over slightly more than 180°, in that in the case of retaining groove, in the resilient engagement aperture, a crest of a corrugated outlet hose or inlet hose may be resiliently engaged and axially secured in said retaining groove, and in that, when there is a retaining web in the retaining aperture, said web may be resiliently engaged and axially secured in a trough or a corrugated outlet hose or inlet hose. In this respect the resilient engagement aperture outwith the retaining groove or retaining web preferably likewise extends over slightly more than 180°, and is provided with an insert opening.

In order to secure and axially fix an inlet valve, an inlet valve is provided with two discs, and forms a receiving means for the retaining web of the resilient engagement aperture, and the discs are non-rotarily held in the expanded resilient engagement aperture, and in addition the inlet valve has between the discs a cross-sectional area which is adapted to the receiving cross-section formed by the retaining web.

Non-rotary fixing may also be achieved if the retaining web has an aperture into which a stop means of the inlet valve may be introduced.

The elements for securing the retaining portion on the rear wall baffle are so constructed and arranged that the stop means and the engagement springs are integrally formed on the retaining portion, the engagement springs being located on the sides of the retaining portion without resilient engagement apertures, and the stop means being distributed on all sides.

According to a particularly advantageous development, the retaining portion may be secured in the rear wall baffle covering the base of the domestic appliance. The outlet hose and the inlet hose or the inlet valve are then located near the bottom.

If counter-stop means are integrally formed on the retaining portion, which form with stop means a plug-in receiving means on the receiving portion for the rear wall baffle, then the retaining portion may be introduced obliquely into the opening in the rear wall baffle, and may then be resiliently engaged.

BRIEF DESCRIPTION OF THE DRAWINGS

The invention will be explained in more detail with reference to an embodiment given by way of example and shown in an exploded view in the drawing. FIG. 1 illustrates a perspective view of a securing device according to the invention.

DESCRIPTION OF THE PREFERRED EMBODIMENT

In the drawing, the opening in the rear wall baffle is not shown. It is co-ordinated to the external dimensions of the retaining portion 10. This retaining portion 10 has in the upper and lower sides respective resilient engagement openings 13 or 16. The retaining portion 10 is plate-shaped, and square or rectangular in form. The outlet hose 20 is resiliently engaged in the lower resilient engagement aperture 16. The outlet hose 20 is corrugated and has crests 21 and troughs 22. The outlet hose 20 is resiliently engaged in the externally open resilient engagement aperture 16 with the expanded inlet opening 18. The resilient engagement opening 16 has a retaining groove 17 which, like the resilient engagement opening 16 itself, extends over slightly more than 180°. During resilient engagement of the outlet hose 20, the retaining groove 17 receives a crest 21 of said hose 20, so that the outlet hose 20 is relieved of tension, i.e. is held axially immovably. During resilient engagement the elastic outlet hose 20 yields slightly, so that it can pass through the narrow point of the resilient engagement aperture 16. The resilient engagement aperture 16 can however also be provided with a retaining web, which is introduced into a trough 22 in the corrugation of the outlet hose 20.

Depending on the type of domestic appliance, the inlet hose 25 or an inlet valve 30 are introduced into the upper resilient engagement aperture 13 with the expanded inlet opening 19. The retaining web 14 again extends over slightly more than 180° and, outwith the retaining web 14, the resilient engagement aperture 13 is rectangular in shape. If the inlet hose 25 is resiliently engaged with the crest 26 and the troughs 27, then the retaining web 14 is introduced into a trough 27, so that the inlet hose 25 is secured in the retaining portion 10 in an axially secured manner.

If however an inlet valve 30 is resiliently engaged in the upper resilient engagement opening 13, then the inlet valve 30 must carry two discs 31 and 32, which imitate a trough. The discs 31 and 32 secure the inlet valve 30 non-rotarily in the resilient engagement means 13. Thus the inlet valve 30 is adapted between the discs 31 and 32 in its cross-section to the receiving cross-section of the retaining web 14. If the retaining web 14 is provided with an additional aperture 15, and if the inlet valve 30 carries a correspondingly-formed projection, then also the inlet valve 30 may thereby be secured non-rotarily in the resilient engagement aperture 13. The resilient engagement aperture 13 may also be round in form and carry a retaining groove 17 or a retaining web 14. In that case the inlet valve 30 has only one portion which has an external contour like the corrugated outlet hose 20 or the corrugated inlet hose 25.

If the outlet hose 20 and the inlet hose 25 or, instead of the latter, the inlet valve 30, are resiliently engaged in the resilient engagement apertures 13 and 16 in the retaining portion 10, then the retaining portion 10 is inserted into the opening in the rear wall baffle. If the retaining portion 12 is provided with lateral engagement springs 12 and stop means 11 distributed around the circumference, then it is introduced obliquely from the outside, i.e. inwards from the plane of the drawing, into the opening in the rear wall baffle. Thus the upper stop means 11 form with counter-stops a receiving means for the rear wall baffle. If the rear wall baffle is introduced between the stop means 11 and the counter-stops 29, then the retaining portion 10 is tilted about the axis 28.

Thus the engagement springs 12 engage behind the rear side of the rear wall baffle and clearly secure the retaining portion 10 with the outlet hose 20 and the inlet hose 25 or the inlet valve 20 on said rear wall baffle.

I claim:

1. A device for securing an outlet hose and an inlet hose or inlet valve to a rear wall baffle of a domestic appliance such as a washing machine, dishwasher and the like, comprising:

a retaining portion adapted to be resiliently engaged into an opening in the rear wall baffle, and the retaining portion has two outwardly open resilient engagement openings in which one of the outlet hose, the inlet hose and the inlet valve may be resiliently engaged and axially immovably secured before resilient engagement of the retaining portion in the opening in the rear wall baffle.

2. A device according to claim 1, wherein the retaining portion is plate-shaped and is square or rectangular in shape, and further comprising stop means and resilient engagement springs integrally formed on the retaining portion, the stop means define the resilient engagement movement by stopping on one side of the rear wall baffle, and the engagement springs resiliently engage behind the other side of the rear wall baffle.

3. A device according to claim 2, wherein the resilient engagement openings are located on two mutually opposite sides of the retaining portion and are round in shape, extending over slightly more than 180°.

4. A device according to claim 3, wherein the resilient engagement openings are provided with expanded inlet openings.

5. A device according to claim 4, wherein the resilient engagement openings extend with a retaining groove or with a retaining web over slightly more than 180°, and a crest of a corrugated outlet hose or inlet hose is resiliently engaged and axially secured in this retaining groove, and, when there is a retaining web in the retaining aperture, said web may be resiliently engaged and axially secured in a trough of a corrugated outlet hose or inlet hose.

6. A device according to claim 5, wherein the resilient engagement aperture with the retaining groove or the retaining web likewise extends over slightly more than 180° and is provided with an inlet opening.

7. A device according to claim 1, wherein an inlet valve is provided with two discs forming a receiving means for the retaining web of the resilient engagement aperture, and the discs are non-rotarily held in the expanded resilient engagement aperture.

8. A device according to claim 7, wherein the inlet valve has between the discs a cross-section which is adapted to the receiving cross-section formed by the retaining web.

9. A device according to claim 8, wherein the retaining web has an opening into which a projection of the inlet valve may be introduced.

10. A device according to claim 9, wherein the stop means and the resilient engagement springs are integrally formed on the retaining portion, the resilient engagement springs being located on the sides of the retaining portion without resilient engagement apertures, and the stop means being distributed on all sides.

11. A device according to claim 10, wherein the retaining portion may be secured in the rear wall baffle covering the base of the domestic appliance.

12. A device according to claim 10, wherein there are integrally formed on the retaining portion counter-stops which form with stop means a plug-in receiving means on the retaining portion for the rear wall baffle.

* * * * *